United States Patent [19]

Sawchuk

[11] Patent Number: 4,705,309

[45] Date of Patent: Nov. 10, 1987

[54] DOORWAY SECURITY SYSTEM

[76] Inventor: Ronald R. Sawchuk, 115, 601 - 10th Ave. S.W., Calgary, Alberta, Canada, T2R 0B2

[21] Appl. No.: 931,055

[22] Filed: Nov. 17, 1986

[30] Foreign Application Priority Data

Nov. 20, 1985 [CA] Canada ..... 495809

[51] Int. Cl.[4] ..... E05C 3/02

[52] U.S. Cl. ..... 292/342; 292/DIG. 15

[58] Field of Search ..... 292/DIG. 9, DIG. 15, 292/263, 304, 342, 343

[56] References Cited

U.S. PATENT DOCUMENTS 4,222,596 9/1980 Delaney ..... 292/342

*Primary Examiner*—Richard E. Moore

*Attorney, Agent, or Firm*—Arnold, White & Durkee

[57] ABSTRACT

Disclosed is a door security device for mounting adjacent a door comprising base plate means adapted to be secured to the frame of a door adjacent a floor. Wedge means is pivotally associated with the base plate means through two hinge means which hinge means are planar and perpendicularly oriented with respect to each other such that the wedge means may be pivoted between an operative position for wedging action with a partially open door and a stored position adjacent the door opening and substantially off the floor.

5 Claims, 7 Drawing Figures

DOORWAY SECURITY SYSTEM

FIELD OF INVENTION

This invention relates to a doorway security system and more particularly to a device which is secured to a door frame and permits partial opening of a door while effectively retaining the safety and security of a locked door.

BACKGROUND OF THE INVENTION

Canadian Pat. No. 962,851 to Waters granted Feb. 18, 1975 pertains to a floor mounted doorstop which is releasably secured to a floor plate mounted in the floor. The stop member is wedge shaped and includes a locking mechanism to selectively lock the member to the floor plate. Obviously, the use of this device requires the floor to be so constructed or modified to accept the floor plate.

U.S. Pat. No. 1,297,189 to Lawler granted Mar. 11, 1919 is representative of door checks which includes a spring controlled link adapted to be pivotally connected at one end with the door and a wedge movably connected with the other end of the link. A spring is connected between the wedge and link to automatically retract the wedge to inoperative position when the door is moved free of the wedge.

Canadian Pat. No. 979,612 to Chezem granted Dec. 16, 1975 relates to a doorstop fastened to the door which is foot actuated after the door is opened. The doorstop is pivoted into place and has an anti-slipping shoe which is jammed forcibly to the floor upon pressure from the outside tending to force the door open. The Chezem devices does not conveniently allow the door to be partially opened before actuation of the stop thereby making its usefulness dependent on the reflexes of the occupant of the house.

Among the most common door security devices presently used are chain devices mounted on the door frame which devices depend on the strength of the mountings and chain. The screws offer the only real resistance against forceful entry and are generally inadequate in case of adult aggression.

It is believed that applicant's device which includes a wedge or inclined plane permanently fastened to the door frame provides for an improved door security device which, through its unique construction, can store itself out of the wav of foot traffic, vacuums and the like.

Accordingly, the invention seeks to provide a door security device which has the strength advantage of a wedge and which, when in operative position, is wedged between the door and the floor. The device stores itself adjacent the door frame.

SUMMARY OF THE INVENTION

The invention in its broader aspect comprehends a door security device for mounting adjacent a door comprising base plate means adapted to be secured to the frame of a door adjacent a floor, wedge means pivotally associated with the base plate means through two hinge means which hinge means are planar and perpendicularly oriented with respect to each other such that the wedge means may be pivoted between an operative position for wedging action with a partially open door and a stored position adjacent the door opening and substantially off the floor.

Preferably one of the hinge means is spring loaded to maintain the device off the floor when in its stored position.

Various other aspects of the invention will become more apparent from the description of a preferred embodiment herein.

DESCRIPTION OF PREFERRED EMBODIMENT

Figure 1:
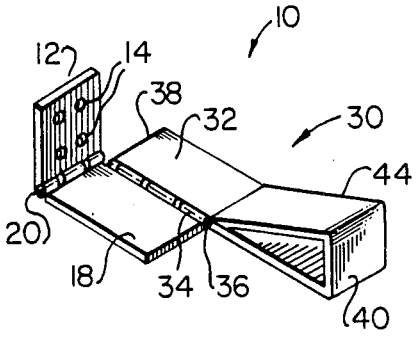
FIG. 1 is a front perspective view of the door security device.

The door security device 10 as shown in FIGS. 1–4 comprises a base plate 12 having a plurality (four being shown) of screw holes 14 preferably countersunk and by which, with appropriate screws, the device may be secured to a door jamb or frame adjacent the opening side of a door.

Floor plate 18 is hinged to the bottom side of base plate 12 by spring loaded hinge 20, hinge 20 having a spring suitable for retaining the device 10 in its "up", "stored" or "off" position as will become more apparent herein.

Wedge 30 has a flat plate portion 32 hinged by hinge 34 to a side of floor plate 18. Plate portion 32 extends beyond the end 36 of hinge 34 and terminates at end 40 which is perpendicular to plate portion 32. Hinge 34 is designed to open to a 180° position only, i.e. where plates 18 and 32 are planar. Upwardly sloping wedging surface 44 (as shown in FIG. 1) starts adjacent the outer end 36 of hinge 34 and meets the upper part of end 40. Inner end 38 of plate 32 is short of the axis of hinge 20.

Figure 4:
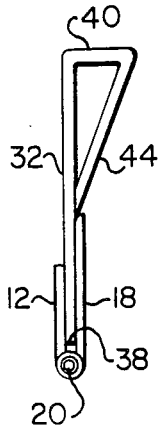
FIG. 4 is a side view of the device in an "up", "off" or "stored" position.
Figure 2:
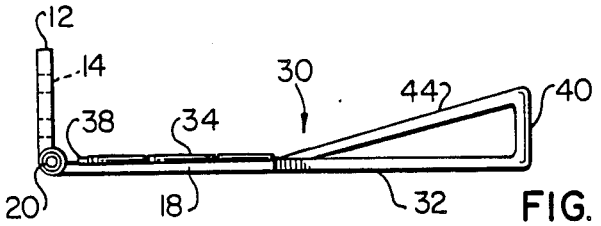
FIG. 2 is a side elevation view of said device.
Figure 3:
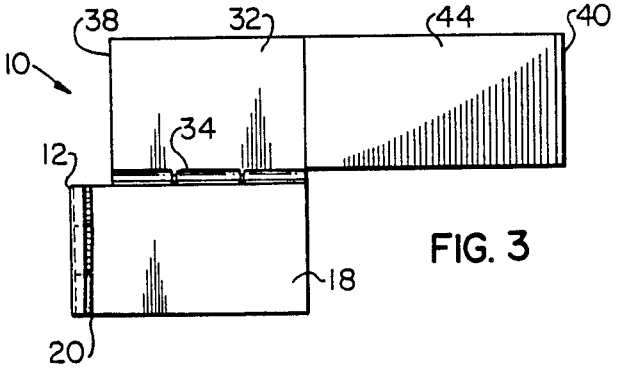
FIG. 3 is a top view of said device.
Figure 5:
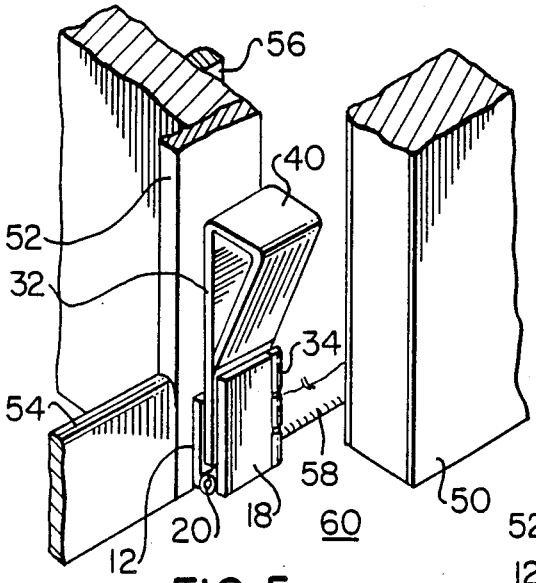
FIG. 5 is a perspective view of the device in a stored position.
Figure 6:
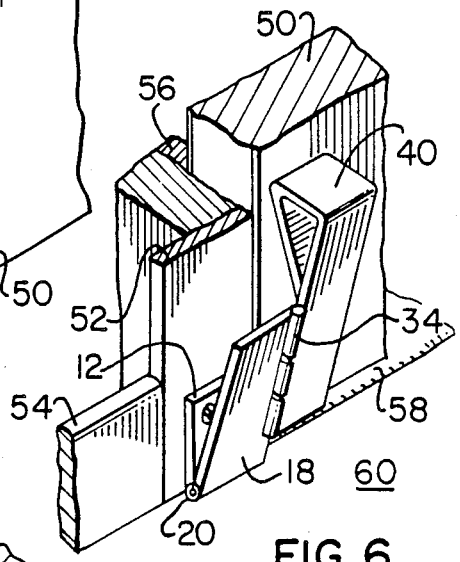
FIG. 6 is a perspective view of the device in an "on" or "operative" position.
Figure 7:
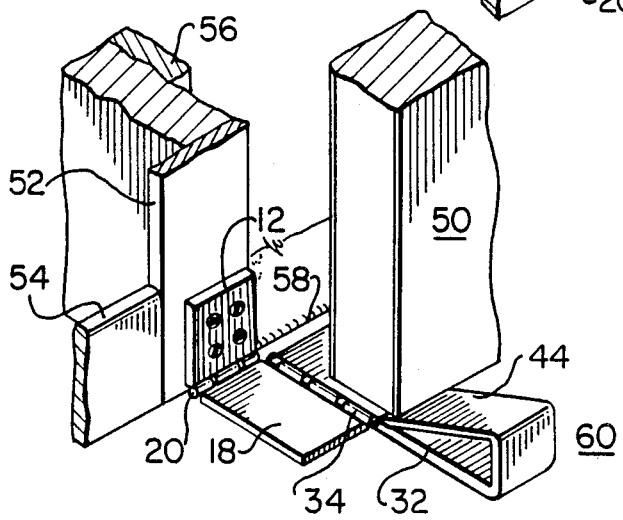
FIG. 7 is a perspective view of the device in "down" position.

FIGS. 4 and 5 illustrate device 10 in its "up", "off" or "stored" position. FIG. 5 in particular illustrates device 10 in conjunction with door 50 which may be opened and closed without encountering device 10. For purposes of illustration only, FIG. 5 and subsequent FIGS. 6 and 7 illustrate part of a door 50 along with door frame or jamb 52, baseboard 54, door stop 56, door threshold 58 and floor 60. Device 10 is stored with plate portion 32 between base plate 12 and floor plate 18 as shown in FIG. 5. Spring loaded hinge 20 is suitably constructed to permit storage in this manner. When device 10 is in its stored or off position, wedge surface 44 extends in a direction outwardly from door jamb or frame 52. The device does not interfere with movement of the door and is retained off the floor 60 so as not to interfere with cleaning and the like.

To place device 10 in an "on" or "operative" position, (FIG. 6), the door being closed, floor plate 18 (and wedge 46, since wedge plate portion 32 is hinged to plate 18 by hinge 34) is pivoted downwardly sufficiently to permit wedge 30 to be pivoted about hinge 34. Spring loaded hinge 20 then pivotally rotates plate 18 and wedge 30 off the floor adjacent the door opening so that it does not impede cleaning the floor adjacent the device.

When the door is opened, (FIG. 7), movement of the door causes plate 18 and wedge 30 to effectively rotate about hinge 20 and the bottom of wedge plate 32 engages the floor thus preventing further opening of the door as a result of a wedging action between the bottom of the door wedge surface 44 and the floor 60.

Assuming that the person at the door is recognized by the occupant, the door is closed sufficiently to permit wedge 30 to be pivoted about hinge 34 and the device will then be pivoted into its "up", "off" or "stored" position by spring loaded hinge 20.

It will also be apparent that the construction of plate 32 and its location relative to the door when the device is in an "operative" position prevents the deactivation of the device from the exterior (outside) of the room. Accordingly, the door may be left open, unattended for ventilation purposes, when the device is in an activated position as shown in FIG. 7.

Various modifications of the invention will be apparent to those skilled in the art. By way of example, for doors opening opposite to that shown in the drawings, a mirror image device 10 would be appropriate. As an alternative, it will be appreciated that plate 18 and plate 32 could have hinge couplings on each side so that a single device could be sold with hinge 34 uncoupled and the consumer chooses the appropriate side of plates 18 and 32 to be coupled with a hingepin depending on the door opening requirements.

Although it is preferred to include a spring means within hinge 20, it will be appreciated that a tension spring between plates 12 and 18 could be utilized. Other means could be used to retain device 10 in its "up" or "stored" position such as a latch mechanism. Further, hinge 36 could be spring biased to an open position so that when plate 18 is moved downwardly from a stored position, wedge 30 automatically moves to its operative position. The strength of the springs of hinge 20 and such spring biased hinge 36 would be such that spring 20 could still retain the device in its "up", "off" or stored position.

Having described my invention and preferred embodiment, it will be apparent that further or additional modifications are possible and all such modifications are part of my invention as fall within the scope of the appended claims.

The embodiments of the invention in which an exclusive property or privilege is claimed are defined as follows:

1. A door security device for mounting adjacent a door comprising:

base plate means adapted to be secured to the frame of a door adjacent a floor;

wedge means pivotally associated with said base plate means through two hinge means which hinge means are planar and perpendicularly oriented with respect to each other such that said wedge means may be pivoted between an operative position for wedging action with a partially open door and a stored position adjacent the door opening and substantially off the floor.

2. A door security device for mounting adjacent a door comprising:

base plate means adapted to be secured to a door frame member adjacent a floor;

floor plate means pivotally hinged to said base plate means by first hinge means so that said floor plate means is pivotable between a generally upright position and a position substantially parallel to the floor;

wedge means having a plate portion and a wedging portion extending outwardly from said plate portion, said plate portion pivotally hinged to said floor plate means by second hinge means, said second hinge means having an axis substantially perpendicular to said first hinge means whereby said wedge means is permitted to move from a face to face position with said floor plate means to a position substantially planar with said floor plate means;

said wedge means configured such that when said device is in an operative position, opening of the door more than a predetermined amount is restricted by a wedging action between the bottom of the door, the wedging portion and the floor.

3. The door assembly as in claim 1 or 2 including means for retaining said device in a stored position.

4. The door assembly as in claim 1 or 2 wherein said first hinge means is spring loaded for retaining said device off the floor other than when said device is restricting opening of the door.

5. The door assembly as in claim 2 wherein said second hinge means is constructed such that relative movement between said wedge means and said floor plate is limited to about 180° and said first hinge means is spring loaded for retaining said device off the floor other than when said device is restricting opening of the door.

* * * * *